US005483945A

United States Patent [19]

Kobayashi et al.

[11] Patent Number: 5,483,945

[45] Date of Patent: Jan. 16, 1996

[54] AIR/FUEL RATIO CONTROL SYSTEM FOR ENGINE

[75] Inventors: Masato Kobayashi, Atsugi; Osamu Matsuno, Ebina; Youichi Kishimoto, Chigasaki; Katsuhiko Kawamura, Yokohama, all of Japan

[73] Assignee: Nissan Motor Co., Ltd., Yokohama, Japan

[21] Appl. No.: 209,048

[22] Filed: Mar. 11, 1994

[30] Foreign Application Priority Data

Mar. 16, 1993 [JP] Japan ..... 5-055959

[51] Int. Cl.[6] ..... F02D 41/14

[52] U.S. Cl. ..... 123/674

[58] Field of Search ..... 123/674, 675; 364/431.05, 431.12

[56] References Cited

U.S. PATENT DOCUMENTS

| | | | |
|---|---|---|---|
| 4,800,857 | 1/1989 | Tomisawa | 123/674 |
| 4,870,938 | 10/1989 | Nakaniwa | 123/674 |
| 5,003,955 | 4/1991 | Haraguchi et al. | 123/675 |
| 5,243,951 | 9/1993 | Nakaniwa | 123/674 |
| 5,297,046 | 3/1994 | Nakaniwa | 123/674 |
| 5,320,080 | 6/1994 | Kadowaki | 123/674 |

FOREIGN PATENT DOCUMENTS 60-145443 7/1985 Japan .

OTHER PUBLICATIONS

"Jidosha Kogaku (Automotive Engineering)", Jul. 1991, pp. 72–74.

*Primary Examiner*—Willis R. Wolfe

*Attorney, Agent, or Firm*—Lowe, Price, LeBlanc & Becker

[57] ABSTRACT

A learning control system for controlling an air fuel ratio an engine employs a slowly updated second learning control variable in addition to a normally updated first learning control variable in order to utilize the learning function sufficiently even when a deviation of the air fuel ratio exceeds the learning range of the first variable. The control system according to an illustrated embodiment of the invention identifies a current engine operating area among a plurality of such areas, in accordance with a sensed engine operating condition, obtains a value of the first learning variable corresponding to the identified operating area, and a value of the second learning variable, determines a learning quantity which is a sum of the first and second learning variables by using the obtained values, and uses this learning quantity for determining a desired fuel supply quantity. The second learning variable is updated slowly whereas the first learning variable is updated in a sensitive and speedy manner.

25 Claims, 9 Drawing Sheets

AIR/FUEL RATIO CONTROL SYSTEM FOR ENGINE

BACKGROUND OF THE INVENTION

The present invention relates to a learning control system, and more specifically to an engine air fuel ratio learning control system.

In a so-called three way catalytic conversion system, in order to enhance the conversion efficiencies of the three harmful exhaust components (CO, HC and $NO_x$), a conventional air fuel ratio control system performs a feedback control so as to hold the air fuel ratio of the exhaust gas mixture passing through the catalyst in a predetermined narrow range around the theoretical ratio.

Although the base air fuel ratio (which is the air fuel ratio determined by a basic injection pulse $T_p$ determined in accordance with the output of an air flow meter and the engine speed) is set equal to :the theoretical ratio, the air fuel ratio goes out of order for some reason such as a deviation of a flow characteristic of the air flow meter or the fuel injector from a prescribed standard. In this case, the output of an $O_2$ sensor changes; → a computer varies the fuel injection quantity little by little to reduce the deviation of the air fuel ratio; → the output of the $O_2$ sensor returns gradually to the normal level; → the air fuel ratio returns gradually to the theoretical ratio. The control system controls the air fuel ratio at or near the theoretical value by repeating this process.

However, it takes more or less time for the feedback control system to return the actual air fuel ratio to the theoretical ratio, and, during that time, a bad condition lingers. Thereafter, the control system can maintain a normal state until a next stop of the engine. When the engine is restarted, however, the control system must repeat the above-mentioned feedback cycle of monitoring the output of the $O_2$ sensor and adjusting the injection quantity. Namely, the abnormal condition persists for a while each time the engine is started. Moreover, the air fuel ratio remains out of order while the air fuel ratio feedback control is held in abeyance in some engine operating states as in a starting operation, a cold operation in which the temperature of the cooling water is low and a high load operation.

Therefore, some air fuel feedback control systems are devised to have a learning function to improve the response characteristic of the air fuel ratio control ("*Jidosha Kogaku* (Automotive Engineering)", Jul., 1991, pages 72 ~74; and Japanese Patent Provisional Publication No. 60-145443).

The control system having this learning function determines a correction quantity (or a learning variable) required for a learning control by monitoring the performance of the feedback correction, and stores the learned data in a storage device which can save the contents even after a turn-off of the engine, as long as a back up power source of a computer is normal. By using this learned data, the control system can start an adequate enriching or leaning corrective action from the beginning when the engine is restarted. Therefore, this control system is free from an undesired transient phenomena. With the learning function, the control system can take an immediate and adequate corrective action, instead of repetition of the feedback cycle resulting in a gradual transient variation of the air fuel ratio, and accordingly, the control system can prevent an out-of-order condition from taking place.

Even in the engine operating conditions in which the control system stops performing the feedback control, the control system can continue the correction based on the learned variable to ensure the desirable air fuel ratio, and keep the behavior of the controlled system in order.

The control system updates the learning variable to a new value by comparing with an old one. This update operation is not correctly performed unless the engine operating conditions remain unchanged. Therefore, the control system performs the update operation only when predetermined stringent requirements (learning conditions) are satisfied. The first requirement is that the feedback correction is operative. Under this condition, the control system is trying to reduce a deviation from the theoretical ratio even though there is some difference in the engine operating conditions. Another requirement is that the output of the oxygen sensor has been sampled a predetermined number of times in the same one of a plurality of learning areas.

An object of the conventional learning function is to smooth the nonuniformity from product to product and to eliminate a deviation of the base air fuel ratio. Therefore, the learning range is narrow (±10%, for example), and the updating speed of the learning variable is relatively fast.

The conventional learning system, however, cannot provide a satisfactory performance when there arises such a severe deviation of the air fuel ratio as to overstep the learning range. When, for example, the air fuel ratio swerves sharply to the rich side because of an accidental failure in a part of the engine fuel system, then the learning variable decreases at a relatively high speed in an effort to bring back the air fuel ratio to the lean side. The conventional learning variable, however, shortly reaches the lower limit of the rather narrow learning range, and stays clingingly at the lower limit, blocking further advance of the learning control. Without the lower limit, the learning variable would be further decreased until an equilibrium is reached. When the deviation of the air fuel ratio is excessive, the learning control does not function properly, and the exhaust performance becomes worse.

SUMMARY OF THE INVENTION

It is therefore an object of the present invention to provide an engine air fuel ratio control system which can provide a satisfactory learning control performance even when the deviation of the air fuel ratio is excessive.

According to the present invention, an air fuel ratio control system for an engine, comprises:

- an oxygen sensor for producing an oxygen sensor signal representing an air fuel ratio of exhaust gases of the engine;
- a feedback correcting means for determining a feedback correction quantity in accordance with the oxygen sensor signal and performing a feedback correcting operation to maintain an air fuel ratio near a theoretical air fuel ratio;
- a first memory section (learning map) for storing at least one value of a first learning variable for at least one learning region;
- a second memory section for storing a value of a second learning variable which is distinct from the first learning variable;
- a fuel injection quantity determining means for determining a fuel injection quantity by modifying a basic injection quantity corresponding to the engine operating condition, in accordance with the feedback correction quantity and the first and second learning variables;

a fuel supplying means for supplying fuel in the fuel injection quantity to an intake passage of the engine;

a first updating means for updating the first learning variable stored in the learning map in a narrow learning range at a fast learning rate in accordance with the feedback correction quantity; and a second updating means for updating the second learning variable stored in the memory at a slow learning rate which is lower than the fast learning rate in accordance with the learning quantity.

The control system may further comprises a calculating means for reading the value of the first learning variable from the first memory section and the value of the second learning variable from the second memory section, and calculating a learning quantity which is a sum of the first and second learning variables.

FIG. 1 shows one example. The control system shown in FIG. 1 includes the oxygen sensor 131, the feedback correction means 132 for determining the feedback correction quantity (α), the learning map 133 for storing the values of the first learning variable (A), the memory 134 for storing the value of the second learning variable (B), the calculating means 135 for calculating the learning quantity (KBLRC), the fuel injection quantity determining means 136 for modifying the basic injection quantity (Tp), the fuel supplying means 137, the first updating means 138 and the second updating means 139.

DETAILED DESCRIPTION OF THE INVENTION

Figure 1:
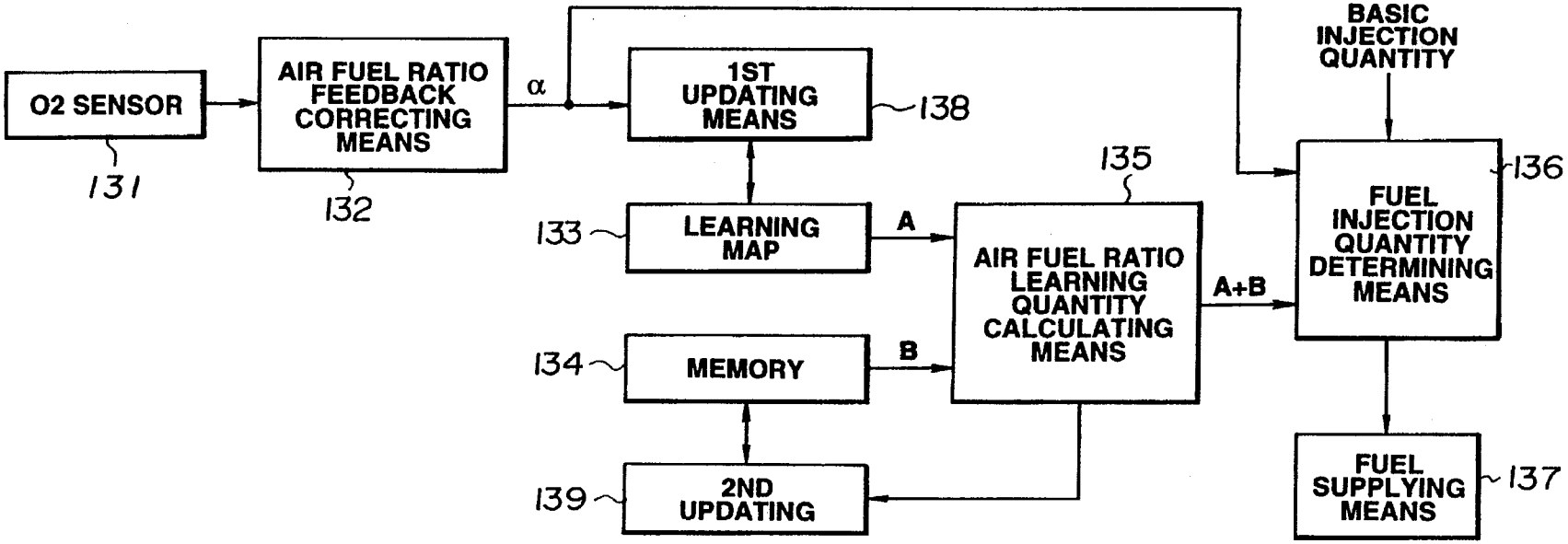
FIG. 1 is a block diagram showing one arrangement of various means employed in the present invention.
Figure 2:
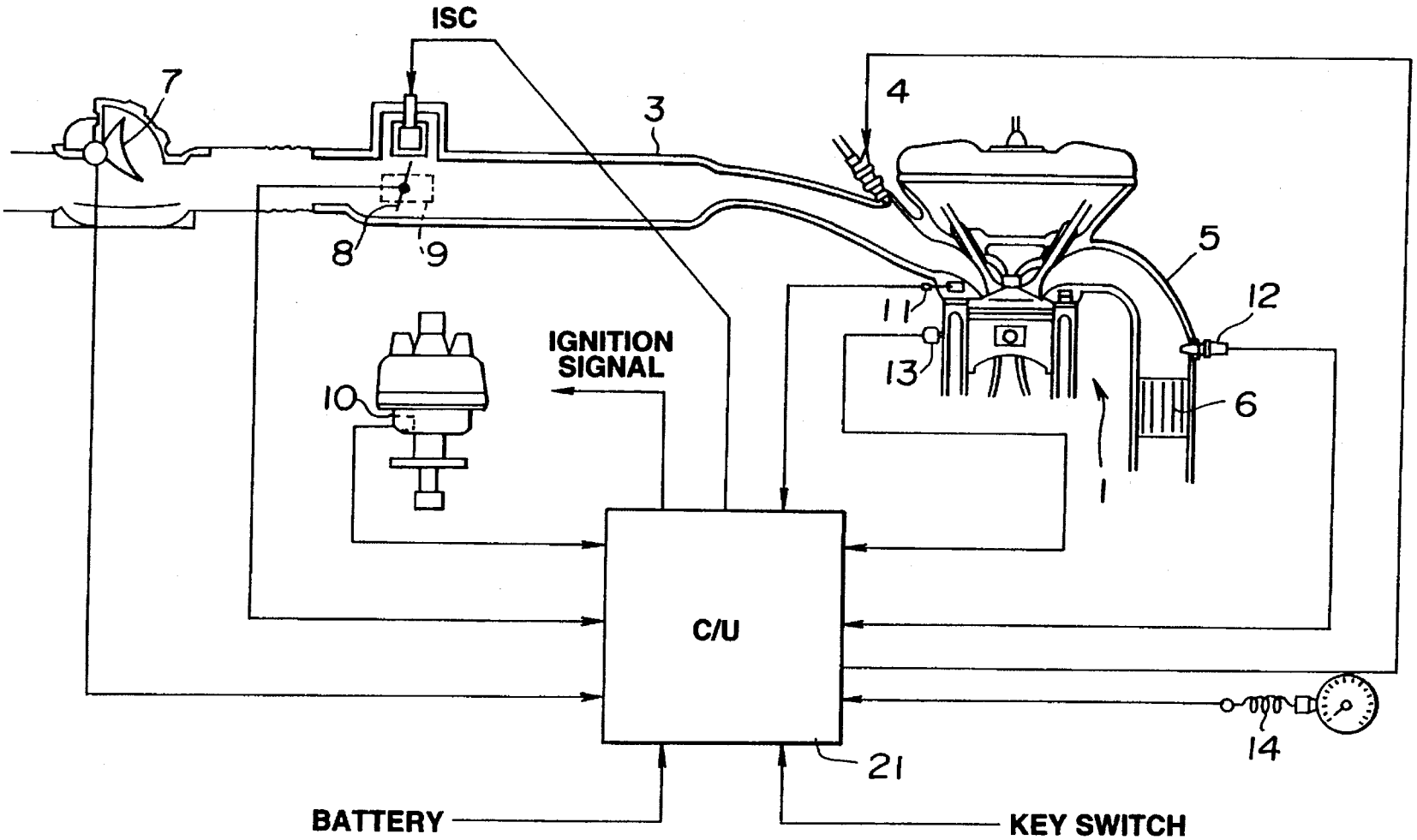
FIG. 2 is a schematic view showing an air fuel ratio control system according to one embodiment of the present invention.

FIG. 2 shows an air fuel ratio control system according to one embodiment of the present invention.

This air fuel ratio control system includes a sensor group which comprises an air flow meter (or sensor) 7 for measuring the flow rate Qa of intake air sucked through an air cleaner, an idle switch 9, a crank angle sensor 10 for producing a unit crank angle signal representing each unit crank angular displacement and a reference crank angle signal (Ref signal) for signaling each time a reference angular position is reached, a water (coolant) temperature sensor 11, and an oxygen ($O_2$) sensor 12 for producing an air fuel ratio signal which responds to the oxygen content of exhaust gases of an internal combustion engine 1 and which differs sharply between the rich and lean sides of the theoretical (stoichiometric) ratio, a knock sensor 13, and a vehicle speed sensor 14.

A control unit 21 of this control system includes a microcomputer as a main component. All the sensors and switches of the sensor group are connected with the control unit 21. The control unit 21 can obtain information on various engine operating parameters, such as engine load and engine speed, by receiving the signals from the sensor group.

A fuel injector 4 serves as an actuator of this control system. The fuel injector 4 is placed at one point in an intake port, and sprays fuel under the control of the control unit 21. The control unit 21 controls the amount of fuel injected by controlling the injection time which is the length of time of fuel injection. The fuel injection quantity increases as the injection time increases. The injection quantity decreases as the injection time decreases. The concentration or the air fuel ratio of the air fuel mixture becomes richer as the fuel injection quantity increases with respect to a predetermined amount of intake air, and learner as the fuel injection quantity decreases.

Therefore, it is possible to maintain a constant air fuel ratio regardless of changes in the engine operating conditions by determining a basic fuel injection quantity so as to hold the ratio to the intake air amount constant. When the fuel injection is performed once in each revolution of the engine, a basic fuel injection pulse width Tp (=K.Qa/Ne, where K is a constant) with respect to the amount of air inducted in one revolution is determined in accordance with the current values of the intake air amount Qa and the engine speed Ne. Normally, the air fuel ratio (base air fuel ratio) determined by this basic fuel injection pulse width Tp is at or near the theoretical (stoichiometric) air fuel ratio in an air fuel ratio feedback correction region.

There is provided, in an exhaust pipe 5 of the engine 1, a three way catalytic converter 6 for reducing the three harmful exhaust emissions, CO, HC and NOx from the engine 1. The three way catalytic converter 6 is efficient enough in conversion of these three noxious components only when the atmosphere of the catalyst is within a narrow range (known as a catalyst operating window) extending to a limited extent on both sides of the theoretical air fuel ratio. Even a slight deviation of the air fuel ratio to the rich side from this narrow range causes a fall in the conversion efficiencies of CO and HC. A deviation to the lean side decreases the conversion efficiency of NOx.

The control unit 21 performs feedback correction of the fuel injection quantity, based on the output signal of the oxygen sensor 12, so as to hold the average air fuel ratio near the theoretical ratio for the best efficiency of the three way catalytic converter 6.

The air fuel ratio is on the rich side when the output of the oxygen sensor 12 is higher than a slice level corresponding to the theoretical ratio, and on the lean side when the sensor output is lower than the slice level. The control unit 21 can, therefore, detect an inversion (or change) from the lean side to the rich side or vice versa by monitoring the output of the oxygen sensor 12.

When an inversion of the air fuel ratio to the rich side is detected, the air fuel ratio must be returned to the lean side.

Figure 3:
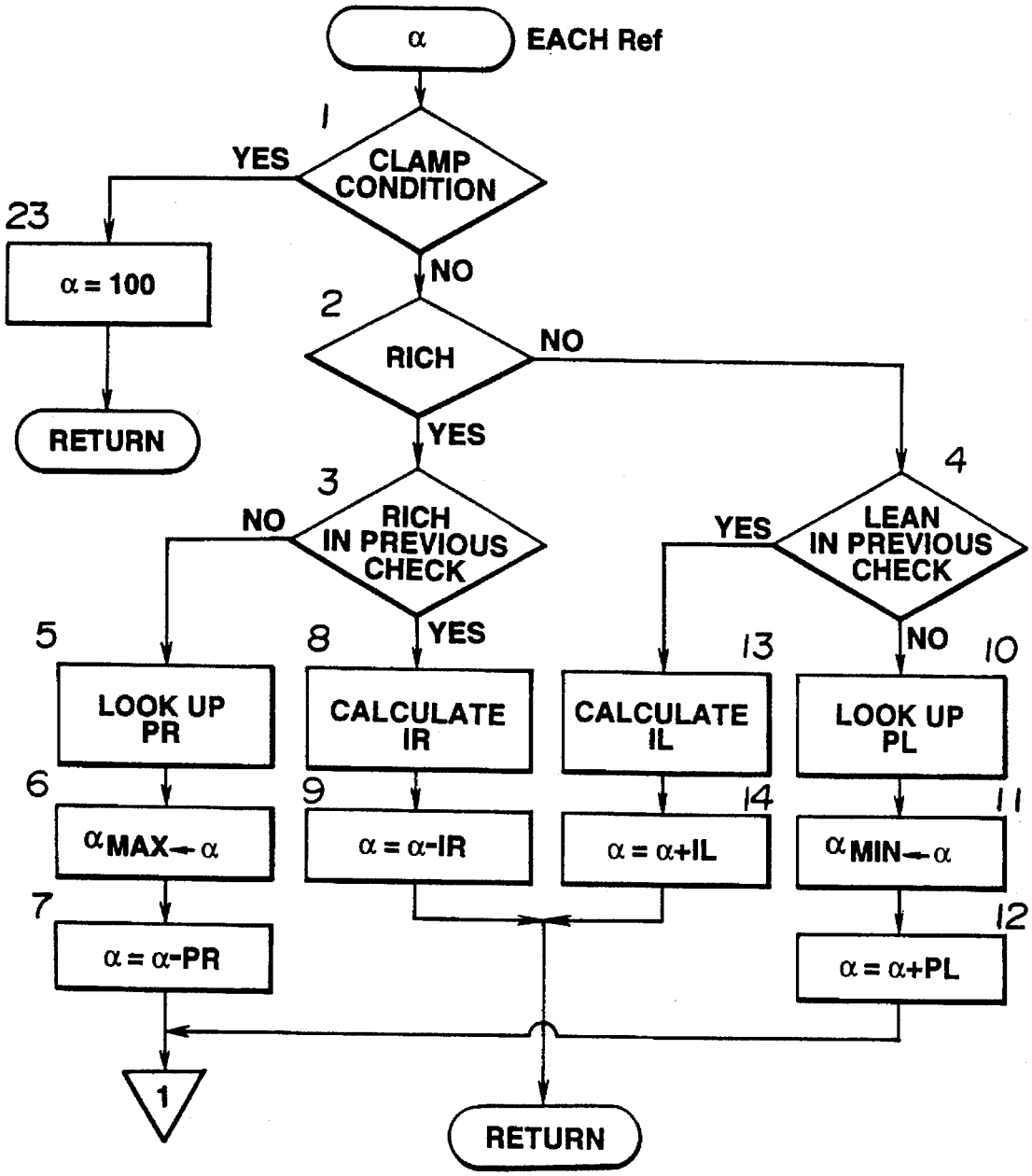
FIG. 3 is a flow chart showing a control procedure which the control system of FIG. 2 performs for determining a feedback correction coefficient α.

As shown in the flow chart of FIG. 3, the control unit 21 of this example subtracts a step component (or proportional component) PR from an air fuel ratio feedback correction coefficient α immediately after an inversion of the air fuel ratio to the rich side (at steps 2, 3 and 7 in FIG. 3), and then subtracts an integral component IR from the feedback coefficient α until a next inversion of the air fuel ratio to the lean side (at steps 2, 3 and 9 in FIG. 3).

When, on the other hand, the air fuel ratio is inverted to the lean side, the control unit 21 adds a step component PL to the feedback coefficient α immediately after the inversion (at steps 2, 4 and 12 in FIG. 3), and then adds an integral component IL to the feedback coefficient α until a next inversion of the actual air fuel ratio to the rich side (at steps 2, 4 and 14).

The computation of the feedback correction coefficient α is synchronized with the Ref signal of the crank angle sensor 10. This synchronization is desirable because the fuel injection is synchronous with the Ref signal, and hence the system behaves synchronously with the Ref signal.

The step (or proportional) components PR and PL are much greater than the integral components IR and IL. With the greater step components PR and PL, the control system can respond quickly to an invention to the rich or lean side, and take an effective corrective action toward the opposite side without delay. After a step change caused by the step component PR or PL, the control system varies the air fuel ratio gradually to the opposite side with the relatively small integral component IR or IL, to improve the stability of the control system.

Figure 7:
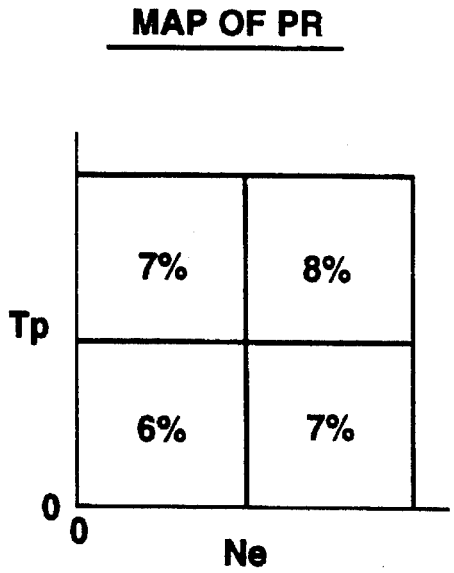
FIGS. 7 and 8 are graphs showing maps of step components PR and PL employed in the control system of FIG. 2.
Figure 8:
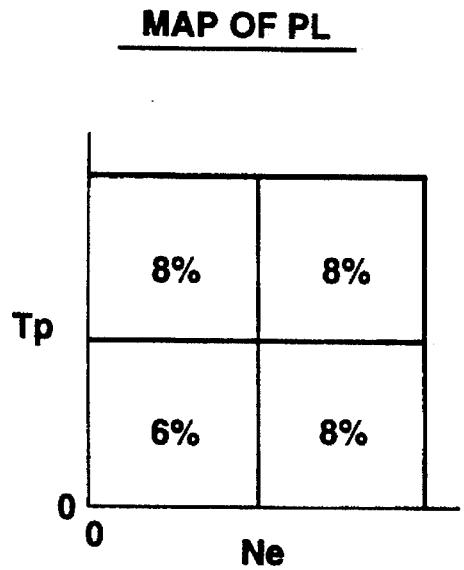

The control unit 21 determines each step component PR and PL by looking up a map having, as parameters, the basic injection pulse width (or pulse duration) Tp and the engine speed (in revolution per unit time) Ne. FIG. 7 shows the map of PR, and FIG. 8 the map of PL. As shown in FIGS. 7 and 8, the step components PR and PL are made different from each other in certain engine operating ranges in order to keep the average air fuel ratio at or near the theoretical ratio even if the output response of the oxygen sensor 12 is different between an inversion to the rich side and an inversion to the lean side, in these operating ranges.

Each of the integral components IR and IL is determined in proportion to a fuel injection pulse width Ti (corresponding to the engine load) (at a step 8 or 13). In an operating range where the control period of the feedback correction coefficient α becomes long, there is the danger that the amplitude of the coefficient α increases so much that the limits of the catalyst window are exceeded. This control system can avoid this possibility by holding the amplitude of the coefficient α approximately constant independent of the control period of the coefficient α, by using the thus-determined integral components IR and IL. It is possible to employ the integral components IR and IL which are equal to each other.

In this way, the control system repeats a cycle of operations to increase the fuel injection quantity from the injector 4 if the exhaust air fuel ratio is on the lean side of the theoretical ratio or to decrease the injection quantity if the air fuel ratio is on the rich side.

Figure 9:
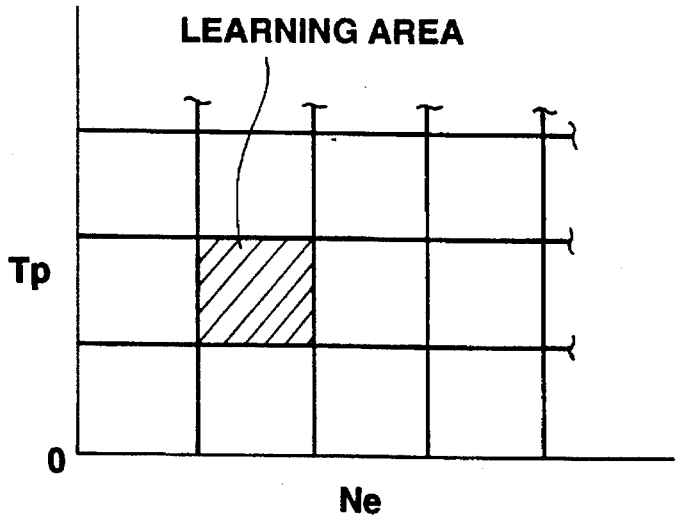
FIG. 9 is a graph showing learning areas employed in the control system of FIG. 2.
Figure 10A:
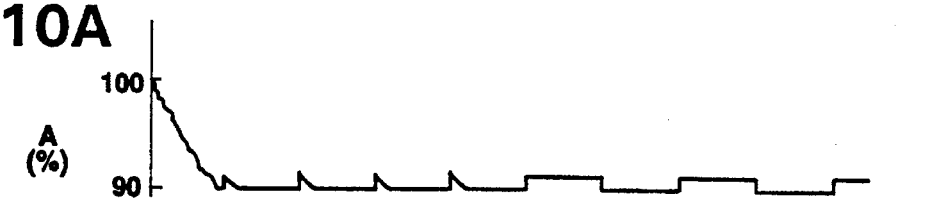
FIGS. 10 and 11 are waveform diagrams for illustrating operations of the control system of FIG. 2.
Figure 10B:
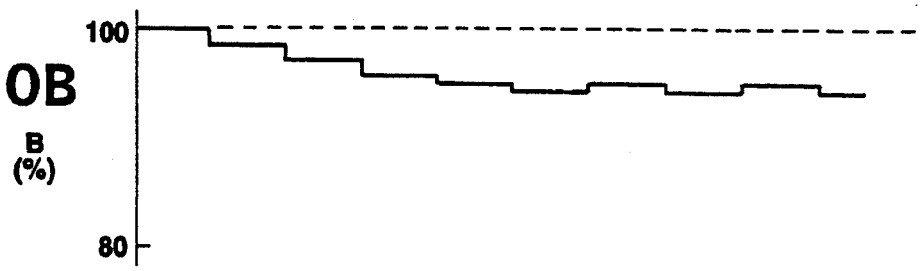
Figure 10C:
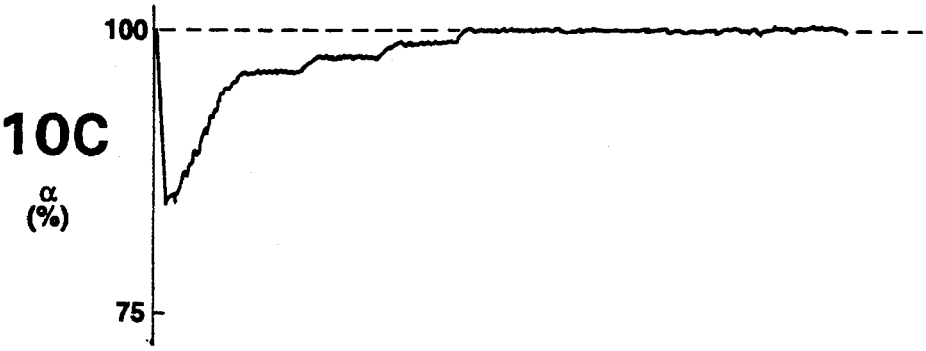
Figure 10D:
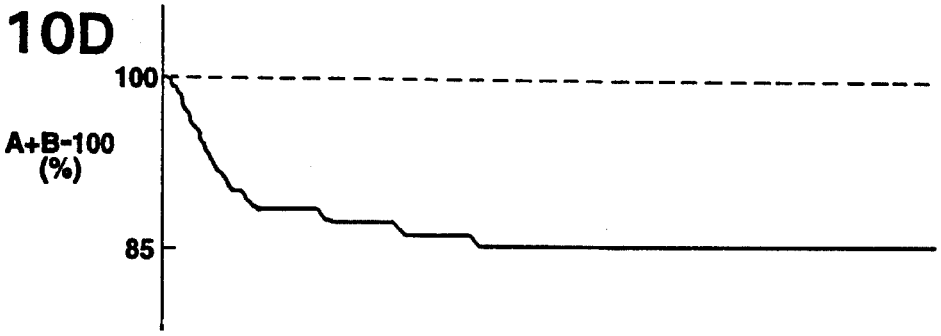
Figure 11A:
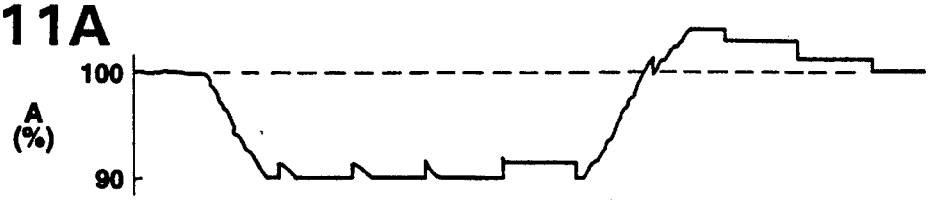
Figure 11B:
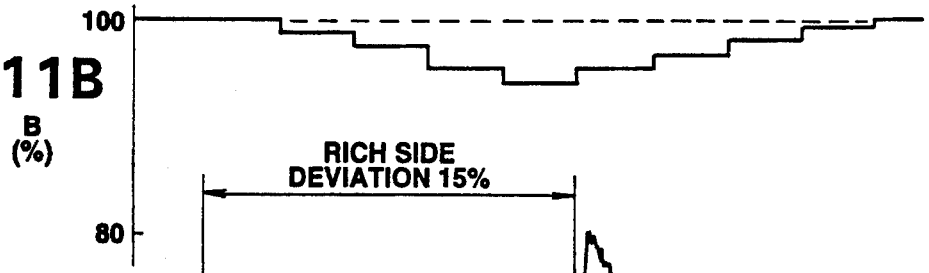
Figure 11C:
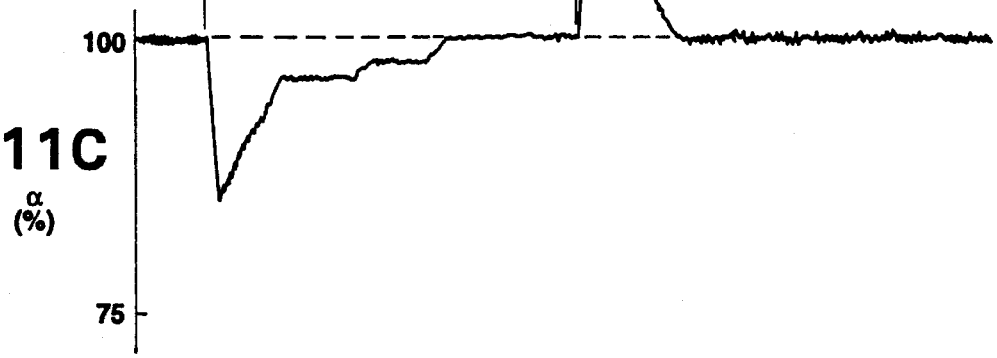
Figure 11D:
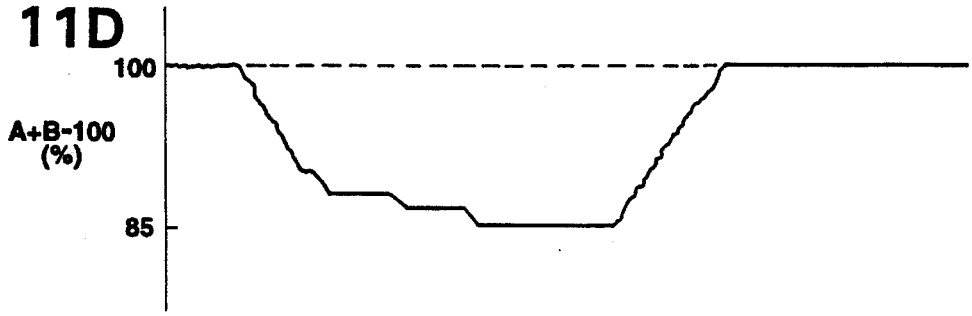

This control system has a learning function. As shown in FIG. 9, the learning region of the air fuel ratio learning is divided into a plurality of subregions (learning areas). Each learning subregion is determined by a predetermined range of the basic injection pulse width Tp and a predetermined range of the engine speed Ne. In the graph of FIG. 9, each subregion is a rectangular area bounded by two vertical line segments and two horizontal line segments. A value of a learning coefficient KBLRC [%] is assigned to each learning subregion. Each value of the learning coefficient is stored in a two dimensional map (learning map) having the basic injection pulse width Tp and the engine speed Ne as parameters. This control system saves the data of this map by using a backup battery even when the ignition key switch of the vehicle is turned off.

The learning control is performed when all the following learning conditions are satisfied.

Figure 4:
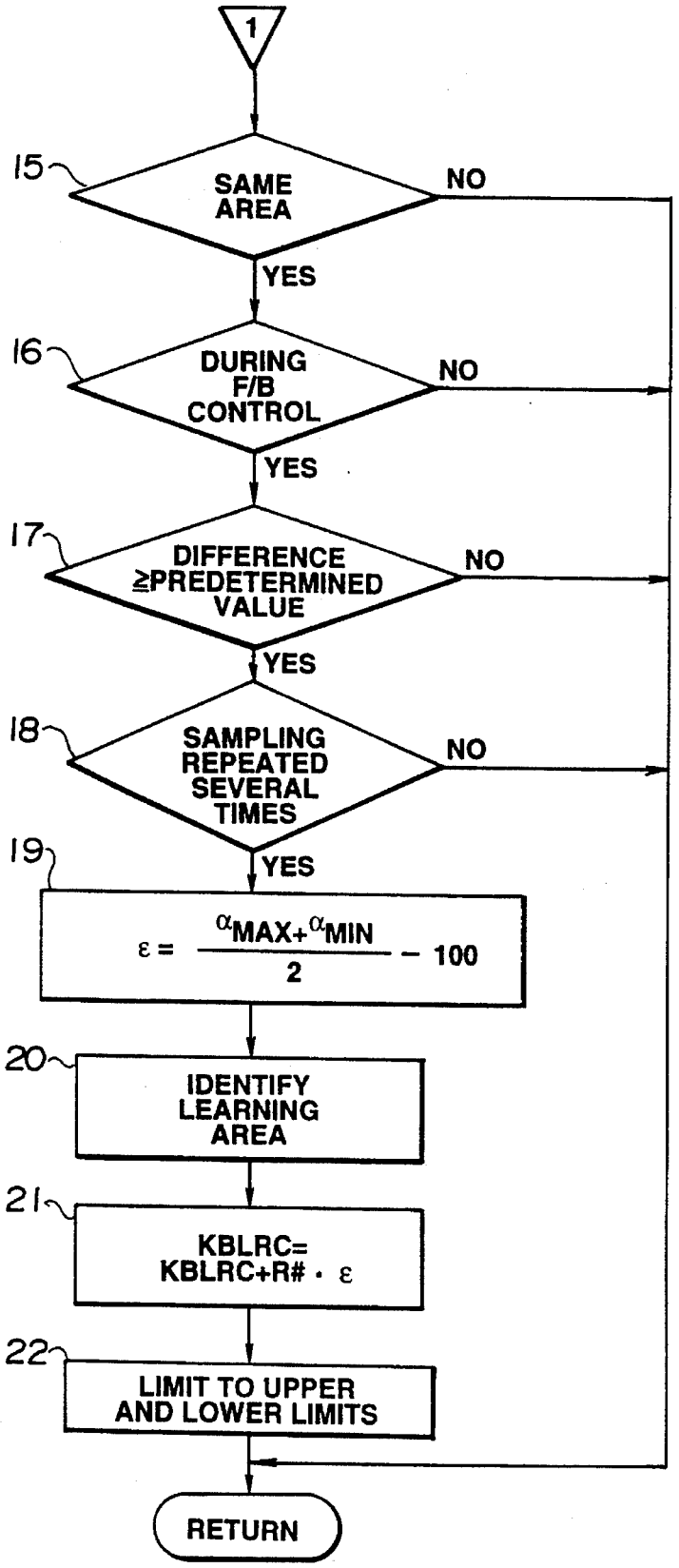
FIG. 4 is a flow chart showing an updating procedure for a first learning variable A employed in the control system of FIG. 2.

(i) The operating point determined by the current basic injection pulse width Tp and the current engine speed Ne must remain in the same area (step 15 in FIG. 4).

(ii) The air fuel ratio feedback control must be operating (step 16 in FIG. 4 ).

(iii) A difference between a maximum value and a minimum value of the output of the oxygen sensor must be equal to or greater than a predetermined value (step 17 in FIG. 4).

(iv) The output of the oxygen sensor has been sampled several times (a predetermined number of times)(step 18 in FIG. 4).

When these learning conditions are satisfied, the control unit 21 (or the CPU of the microcomputer) determines (at a step 19) a deviation ϵ[%] from the center [100%] of control of the feedback coefficient α by using;

$$\epsilon=(\alpha MAX+\alpha MIN)/2-100 \quad (1)$$

where αMAX is a value of the feedback coefficient α immediately before the addition of the step component PR, and αMIN is a value of the feedback coefficient α immediately before the addition of the step component PL.

Then, by using this deviation ϵ, the control unit 21 updates the learning coefficient KBLRC [%] according to;

$$KBLRC=KBLRC+R\#.\epsilon e \quad (2)$$

where R# is a rate of updating (which is a value smaller than one). That is, the control unit 21 (or the CPU) identifies the learning area to which the arguments Tp and Ne existing when the learning conditions are satisfied, belong; reads the value of the learning coefficient in the identified area, out of the map having the contents as shown in FIG. 9; determines the new value (KBLRC in the left member of the equation (2)) by modifying the old value (KBLRC in the right member) with the deviation e; and stores the new value in place of the old value in the identified area in the map (steps 20 and 21 in FIG. 4).

The control unit 21 sets lower limit RLRMIN# and upper limit RLRMAX# to the learning coefficient KBLRC (step 22 in FIG. 4). The learning coefficient KBLRC is restricted between the upper and lower limits RLRMAX# and RLRMIN#.

The learning control is mainly designed to compensate for variations from product to product in the state of a new car, and a deviation in the base air fuel ratio, so that the learning coefficient KBLRC is updated in a narrow learning range at a relatively fast learning rate (or learning speed). The learning range is set at ±10%, for example, by making the lower and upper limits, respectively, equal to 90 and 110% (RLRMIN#=90% and RLRMAX#=110%). The learning speed is set at a high speed by setting the learning rate R# at a relatively high value. The reason for this is that it is possible to control the product to product variation, and the deviation of the base air fuel ratio within predetermined ranges in the production process, and, if deterioration due to aging is such that the allowable ranges are exceeded, it can be dealt with adequately by periodic maintenance inspections.

However, the learning control using only the abovementioned learning variable is unable to provide an adequate corrective action if the deviation of the air fuel ratio is so great as to exceed the learning range. In order to meet this problem, the control system of this example employs a second learning variable B in addition to the above-mentioned learning coefficient KBLRC which is hereinafter referred to as a first learning variable A. Therefore, an air fuel ratio learning quantity KBLRC is determined by;

$$KBLRC=KBLRCA+KBLRCB \quad (3)$$

Figure 6:
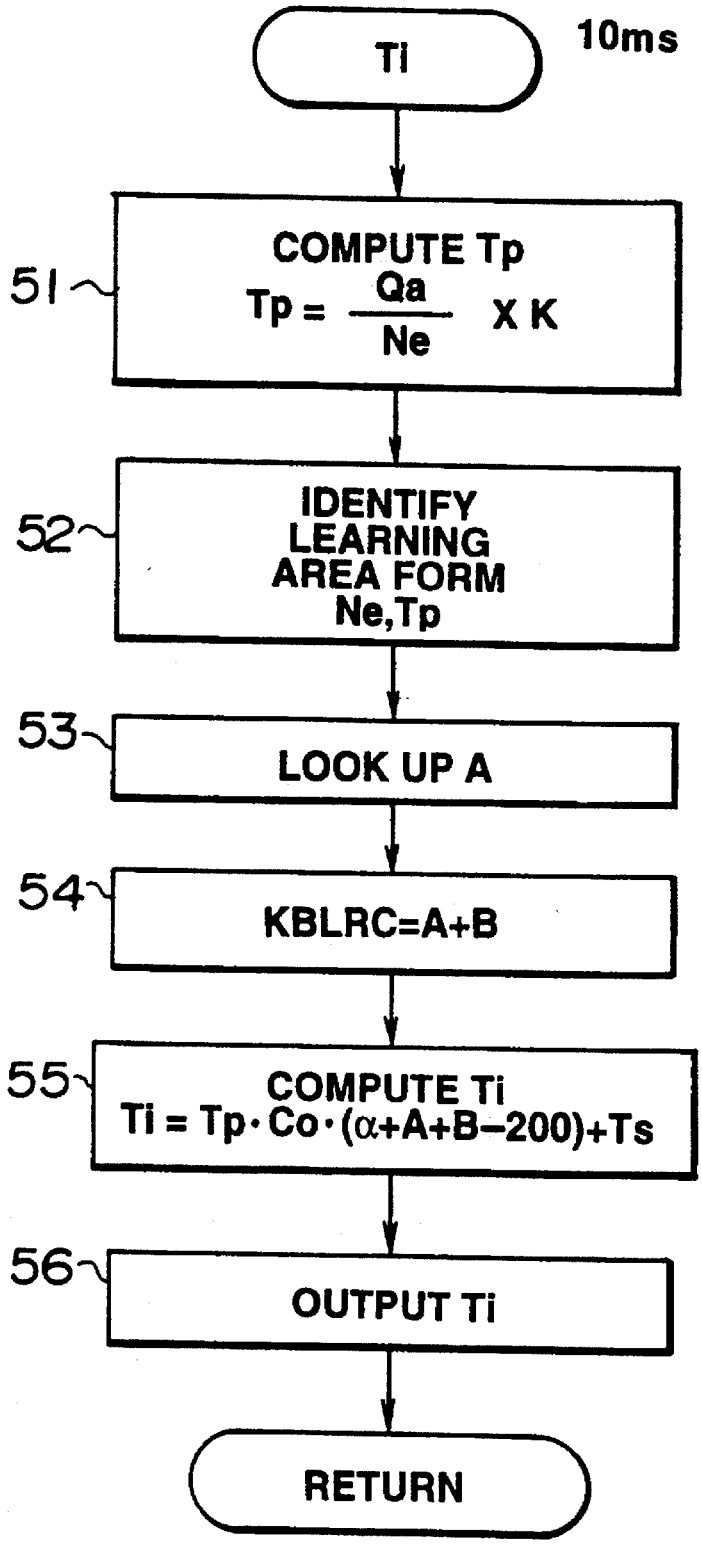
FIG. 6 is a flow chart showing a procedure which the control system of FIG. 2 performs to compute a fuel injection pulse width Ti.

On the other hand, a fuel injection pulse width Ti is given by;

$$Ti=Tp.CO.(\alpha+A+B-200)+Ts \quad (4)$$

where Tp is a basic injection pulse width, CO is a sum of one and various correction coefficients, α is the air fuel ratio feedback correction coefficient, and Ts is an ineffective pulse width (FIG. 6).

An initial value of the first learning variable A is equal to 100% as in the conventional system. An initial value of the second learning variable B is also 100%.

As to the second learning variable B, unlike the first learning variable A, there are provided no learning areas. That is, this control system uses only one value of the second learning variable B for the entirety of the engine operating ranges in order to increase the frequency of learning. The second learning variable B is stored in the memory protected by the backup battery or another backup power source, and saved even when the ignition key switch is turned off.

The second learning variable B is updated in the following manner, in synchronization with the engine revolution as in the case of the first learning variable A (every 16 revolutions of the engine, for example).

The control unit 21 compares the algebraic sum α+A−100 with an air fuel ratio lean side limit KBLGH# at the start of the learning. If α+A−100>KBLGH#, then the control unit 21 updates the second learning variable B by using the following equation (5) (steps 32 and 33 in FIG. 5).

$$B=B+KBLB\#\times(KBLRC/100) \ldots (5)$$

where KBLB# is a rate of updating. The quantity α+A−100 represents an air fuel ratio error (or a deviation from the theoretical ratio) remaining uncorrected in spite of the corrective action based on the feedback coefficient α and the first learning variable A. If this error is equal to or greater than the lean side limit KBLGH#(about 105~115%, for example) (that is, the deviation on the lean side is great), then the control system attempts to drive back the air fuel ratio to the rich side by updating the second learning variable to the greater side.

If, on the other hand, α+A−100<KBLGH# and B≧100, then the control unit 21 judges that the air fuel ratio error left uncorrected by the feedback coefficient α and the first learning variable A is smaller than the lean side limit of KBLGH#, and accordingly, updates the second learning variable B to the smaller side (steps 32, 36 and 37 in FIG. 5) by using;

$$B=B-KBLB\#\times(KBLRC/100) \ldots (6)$$

Figure 5:
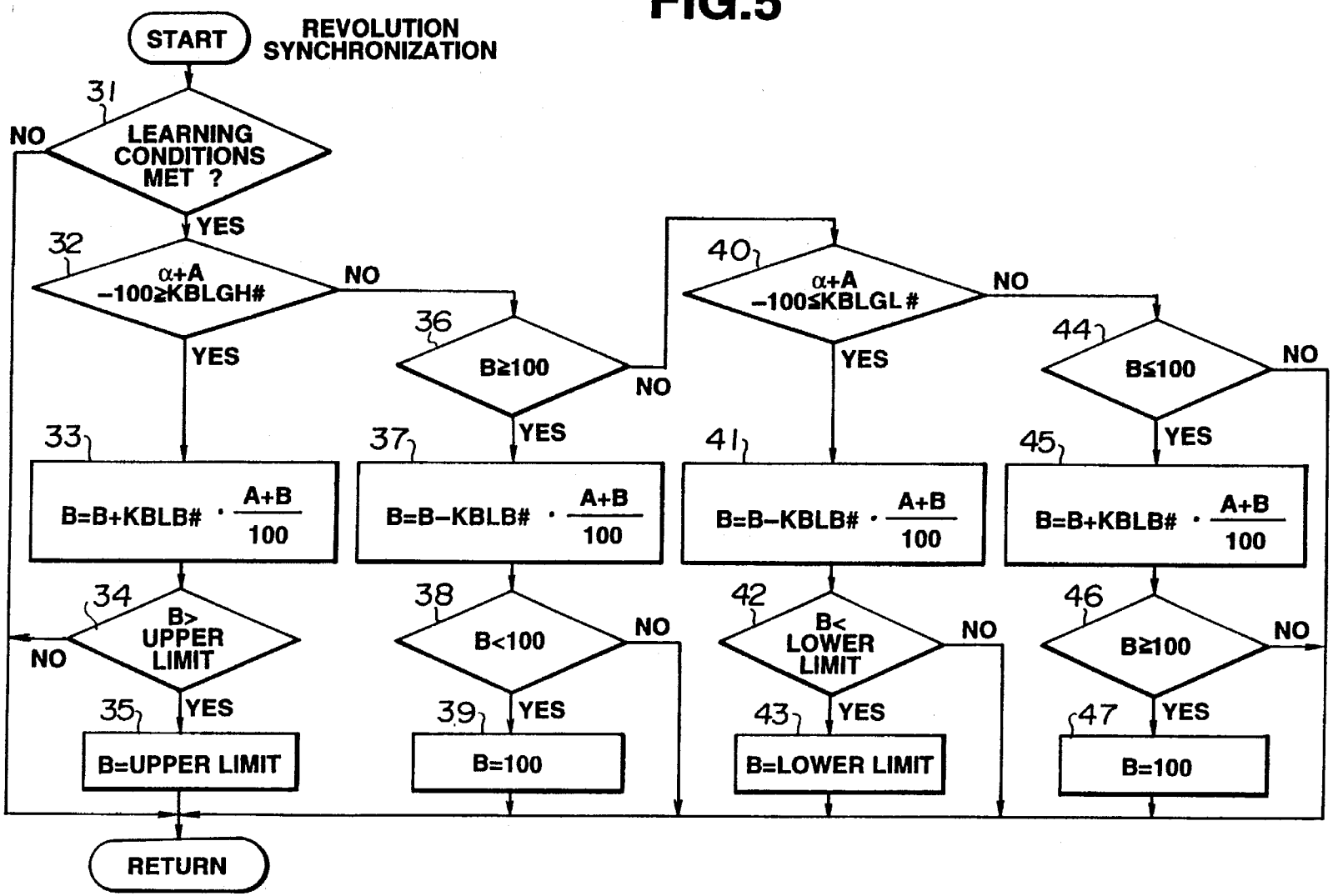
FIG. 5 is a flow chart showing an updating procedure for a second learning variable B employed in the control system of FIG. 2.

If the result of the update is smaller than 100 (B<100), then the control unit 21 limits: the second learning variable B to 100 (B=100) (steps 38 and 39 in FIG. 5).

Similarly, the control unit 21 compares α+A−100 with an air fuel ratio rich side limit KBLGL# at the start of the leaning. If the quantity α+A−100 is equal to or smaller than the rich side limit KBLGL#(about 95~85%, for example) (α+A−100≦KBLGL#), then the control unit 21 judges that the air fuel ratio error left uncorrected by the feedback coefficient α and the first learning variable A is equal to or greater than the rich side limit of KBLGL#, and accordingly, updates the second learning variable B to the smaller side (steps 40 and 41 in FIG. 5) by using the equation (6).

If α+A−100>KBLGL# and B≦100, then the control unit 21 updates the second learning variable B to the greater side (steps 40, 44 and 45 in FIG. 5) by using the equation (5). If the result of the update is equal to or greater than 100 (B≧100), then the control unit 21 limits the second learning variable B to 100 (B=100) (steps 46 and 47 in FIG. 5).

In order to avoid disturbances of purge gases from an activated carbon canister and blow-by gases, the rate of learning KBLB# is set at such a small value as to lower the speed of learning as much as possible.

Like the first learning variable A, the second learning variable B is restricted between a lower limit and an upper limit (steps 34, 35, and 42, 43 in FIG. 5).

The control unit 21 judges that the learning conditions for the second learning variable B are satisfied when all the following conditions ale met (step 31 in FIG. 5). The following conditions are similar to the learning conditions for the first learning variable A.

(i) The cooling water temperature TW is equal to or higher than a lower temperature limit, and lower than an upper temperature limit. When the water temperature TW is equal to or higher than the predetermined upper limit (In a hot state), the purge gases may exert influence. When the water temperature TW is lower than the predetermined lower limit (in a cool state), the base air fuel ratio is not stable under the influence of a wall flow of the fuel. Therefore, the control system does not perform the learning operation in these states.

(ii) The basic injection pulse width Tp is greater than a lower limit width value. In order to avoid an influence of the blow-by gases in the region (low air flow rate region) in which Tp is smaller than the lower limit, and for other reasons, the control system prohibits the learning in this low air flow rate region. The blow-by gases may be left without being recirculated in a higher load region, and the remnant blow-by gases may be sucked and enrich the fuel mixture in the subsequent low air flow rate region such as idling. The control system can avert this undesired influence.

(iii) The engine speed Ne is equal to or higher than a predetermined lower speed limit.

(iv) A water temperature TWINT at starting is equal to or higher than a lower limit.

(v) The feedback air fuel ratio control is under way.

(vi) The clamping of the feedback air fuel ratio control is not being performed.

(vii) The idle switch is off. This control system interrupts the learning during idling in which influences of the blow-by gases and output variation of the air flow meter are significant.

(viii) The purge from the canister is not performed. Although the learning speed of the second learning variable B is slow, the variable B is apt to be updated wrongly when the purge gases have direct influences. Therefore, this control system suspends the learning operation during purging.

This control system is operated as follows:

When the first and second learning variables A and B are in the initial state (that is, A and B are both equal to 100%), and, in this state, the air fuel ratio deviates beyond the learning range of the learning variable A (for example, 15% on the rich side in the entire operating ranges):

In this case, the feedback coefficient α is shifted to a smaller side smaller than 100% to return the air fuel ratio to the lean side, and accordingly, the first learning variable A is decreased from 100% at a relatively high speed. However, the first learning variable A reaches the lower limit 90% soon, and stays at the lower limit persistently, so that the learning does not proceed from there.

In this control system, however, the second learning variable B works in such a situation. The learning speed of the second learning variable B is so slow that the second learning variable does not work (remains at the initial value, that is) until the first learning variable A reaches the lower limit of 90%, as shown in FIG. 10. After the arrival of the first learning variable A at the lower limit, the second learning variable B decreases gradually from 100% at a low speed. In this way, this control system advances the; learning by using the second learning variable B even in the case of the air fuel ratio deviation exceeding the learning range of the first learning variable A. By so doing, this control system can rapidly restore the air fuel ratio to the theoretical ratio without delay.

The base air fuel ratio may deviate temporarily by 15% to the rich side because of introduction of the blow-by gases into the intake pipe. In this case, too, this control system proceeds with the learning by using the second learning variable B after the first learning variable A reaches the lower limit of 90%, as shown in FIG. 11. As a result, the air fuel ratio rapidly returns to the theoretical ratio. This control system employs the above-mentioned second learning condition (ii) to deal with the case in which the influence of the blow-by gases is very strong (the case in which the deviation of the base air fuel ratio is equal to or more than 20% on the rich side). When the influence of the blow-by gases is relatively small (15% as shown in FIG. 11), the control system updates the second learning variable B.

In this way, this control system employs the second learning variable B which is distinct and different in properties from the first learning variable A, and advances the learning so as to prevent deterioration of the exhaust performance even when the air fuel ratio deviates beyond the limit of the first learning variable for some reason such as a failure in a part of the fuel system.

The second learning variable B is updated frequently (the learning frequency is high) because the second learning variable has only one value for the whole of the engine operating region. As to the first learning variable A, the engine operating region is divided into a plurality of the learning areas as shown in FIG. 9 because the requirements to the learning variable are different depending on the engine operating conditions. In contrast to this, the object of the second learning variable B is to promote the learning with respect to the air fuel ratio deviation exceeding the limit of the first learning variable A. Therefore, this control system facilitates the learning process by increasing the learning frequency of the second learning variable B.

In the illustrated embodiment of the present invention, the control unit of the air fuel ratio control system comprises a dual updating means comprising a first updating means, corresponding to the steps 15~22 shown in FIG. 4, for determining a deviation of an average of the feedback correction quantity from a predetermined neutral value and updating the first learning variable by using the deviation, and a second updating means, corresponding to the steps 31~47 shown in FIG. 5, for replacing a current entry of the second learning variable B with a new entry which is a linear combination {B±KBLB#.(A+B)/100} of the current entry and the product between the second learning rate (KBLB#) and the learning quantity (A+B). The average of the feedback correction quantity (α) may be (αMAX+αMIN)/2 as in the equation (1) or may be a half of a most recent value of the peak-to-peak amplitude of α. The neutral value is 100%, for example. The control unit may further comprise a fuel injection quantity determining means, corresponding to the step 55 shown in FIG. 6, for determining the desired fuel supply quantity {Ti or Tp.(a+A+B−200)} by multiplying the basic fuel supply quantity (Tp) by an adaptive feedback factor (such as α+A+B−200). The second updating means may include a means for comparing an error (α+A−100) which is a difference obtained by subtracting the neutral value (100%) from the sum (α+A) of the feedback correction quantity (α) and the first learning variable (A), with each of a predetermined lean side limit value (KBLGH#) and a predetermined rich side limit value (KBLGL#), comparing the second learning variable (B) with the neutral value, and determining the new entry (B) of the second variable which, on one hand, is equal to a sum obtained by adding an additional quantity {KBLB#.(A+B)/100} to the old entry (B) of the second learning variable when the error (α+A−100) is equal to or greater than the lean side limit value (KBLGH#) and when the error is greater than the rich side limit value (KBLGL#) and the second learning variable is equal to or smaller than the predetermined neutral value, and which, on the other hand, is equal to a difference obtained by subtracting the additional quantity {KBLB#.(A+B)/100} from the old entry of the second learning variable when the error (α+A−100) is smaller than the lean side limit value (KBLGH#) and the second learning variable is equal to or greater than the neutral value and when the error is equal to or smaller than the rich side limit value (KBLGL#). The additional quantity is a product obtained by multiplying the second rate (KBLB#) by a fraction whose numerator is the sum (A+B) of the first and second learning variables and whose denominator is the neutral value (100%), The second updating means can use, in the steps 32–45, the most recent values of the first and second learning variables A and B which have been used in the last execution of the step 55. The second updating means can also use the most recent value of α which has been used in the last execution of the step 55. The first updating means may comprises a first limiting means corresponding to the step 22, for limiting the first learning variable between first upper and lower limit values, and a first condition discriminating means corresponding to the steps 15~18, and the second updating means may comprises a second limiting means corresponding to the steps 34, 35, 42 and 43, for limiting the second learning variable between second upper and lower limit values, and a second condition discriminating means corresponding to the step 31. The first learning range which is a difference between the first upper and lower limit values may be smaller than a second learning range which is a difference between the second upper and lower limit values.

What is claimed is:

1. An air fuel ratio control system for an engine, comprising:

an oxygen sensor for producing an oxygen sensor signal representing an air fuel ratio of exhaust gases of said engine;

a feedback correcting means for determining a feedback correction quantity in accordance with said oxygen sensor signal and performing a feedback correcting operation to maintain an air fuel ratio near a theoretical air fuel ratio;

a first memory section for storing a value of a first learning variable;

a second memory section for storing a value of a second learning variable which is distinct from said first learning variable;

a fuel injection quantity determining means for determining a fuel injection quantity by modifying a basic injection quantity corresponding to an engine operating condition, in accordance with said feedback correction quantity and said first and second learning variables;

a fuel supplying means for supplying said fuel injection quantity of fuel to an intake passage of said engine;

a first updating means for updating said first learning variable stored in said first memory section at a fast learning rate in accordance with said feedback correction quantity; and a second updating means for updating said second learning variable stored in said second memory section at a slow learning rate which is lower than said fast learning rate in accordance with at least one of said first and second learning variables, wherein said first memory section comprises a means for storing a value of said first learning variable for each of a plurality of first learning regions which are different portions of an engine operating region, said second memory section comprises a means for storing the value of said second learning variable for a second learning region which is different from any one of said first learning regions, and said control system further comprises a reading means for reading the value of said first learning variable in the first learning region corresponding to a current engine operating condition, from said first memory section and the value of said second learning variable from said second memory section when the current engine operating condition falls in said second learning region; and said fuel injection quantity determining means includes a means for determining said basic injection quantity in accordance with said feedback correction quantity and the values of said first and second learning variables determined by said reading means.

2. An air fuel ratio control system for an engine, comprising:

an oxygen sensor for producing an oxygen sensor signal representing an air fuel ratio of exhaust gases of said engine;

a feedback correcting means for determining a feedback correction quantity in accordance with said oxygen sensor signal and performing a feedback correcting operation to maintain an air fuel ratio near a theoretical air fuel ratio;

a first memory section for storing a value of a first learning variable;

a second memory section for storing a value of a second learning variable which is distinct from said first learning variable;

a fuel injection quantity determining means for determining a fuel injection quantity by modifying a basic injection quantity corresponding to an engine operating condition, in accordance with said feedback correction quantity and said first and second learning variables;

a fuel supplying means for supplying said fuel injection quantity of fuel to an intake passage of said engine;

a first updating means for updating said first learning variable stored in said first memory section at a fast learning rate in accordance with said feedback correction quantity; and a second updating means for updating said second learning variable stored in said second memory section at a slow learning rate which is lower than said fast learning rate in accordance with at least one of said first and second learning variables, wherein said first memory section includes a means for storing the value of said first learning variable for a first learning region which is a portion of an engine operating region, said second memory section includes a means for storing the value of said second learning variable for a second learning region which is another portion of the engine operating region and which is different from said first learning region, and said control system further comprises a reading means for reading the value of said first learning variable for the first learning region from said first memory section when the first learning region corresponds to a current engine operating condition, and the value of said second learning variable for the second learning region from said second memory section when the second learning region corresponds to the current engine operating condition; and said fuel injection quantity determining means includes a means for determining said basic injection quantity in accordance with said feedback correction quantity and the values of said first and second learning variables determined by said reading means.

3. An air fuel ratio control system for an engine, comprising:

an oxygen sensor for producing an oxygen sensor signal representing an air fuel ratio of exhaust gases of said engine;

a feedback correcting means for determining a feedback correction quantity in accordance with said oxygen sensor signal and performing a feedback correcting operation to maintain an air fuel ratio near a theoretical air fuel ratio;

a first memory section for storing a value of a first learning variable;

a second memory section for storing a value of a second learning variable which is distinct from said first learning variable;

a fuel injection quantity determining means for determining a fuel injection quantity by modifying a basic injection quantity corresponding to an engine operating condition, in accordance with said feedback correction quantity and said first and second learning variables;

a fuel supplying means for supplying said fuel injection quantity of fuel to an intake passage of said engine;

a first updating means for updating said first learning variable stored in said first memory section at a fast learning rate in accordance with said feedback correction quantity; and a second updating means for updating said second learning variable stored in said second memory section at a slow learning rate which is lower than said fast learning rate in accordance with at least one of said first and second learning variables, wherein said first memory section includes a means for storing a value of said first learning variable for each of a plurality of first learning regions which are different portions of an engine operating region determined by an engine load and an engine speed of the engine, said second memory section includes a means for storing the value of said second learning variable for a second learning region which is a portion of the engine operating region and which encompasses at least a portion of a first one of said first learning regions and a portion of a second one of said first learning regions, and said control system further comprises a calculating means for reading the value of said first learning variable in the first learning region corresponding to a current engine operating condition determined by the engine load and the engine speed, from said first memory section and the value of said second learning variable from said second memory section when the current engine operating condition falls into said second learning region, and calculating a learning quantity which is a sum of said first and second learning variables; and said fuel injection quantity determining means includes a means for determining said basic injection quantity in accordance with said feedback correction quantity and said learning quantity determined by said calculating means.

4. An air fuel ratio control system according to claim 3 wherein said first memory section includes a means for storing the values of said first learning variable in a form of a map, and said first updating means includes a means for updating said first learning variable stored in said first memory section in a narrow learning range.

5. An air, fuel ratio control system for an engine, said control system comprising:

an oxygen sensor for producing an oxygen sensor signal representing an air fuel ratio of exhaust gases of said engine;

a feedback correcting means for determining a feedback correction quantity in accordance with said oxygen sensor signal and performing a feedback correcting operation to maintain an air fuel ratio near a theoretical air fuel ratio;

a first memory section for storing a value of a first learning variable for each of a plurality of first learning regions which are different subregions of an engine operating region;

a second memory section for storing a value of a second learning variable for a second learning region which contains all of said first learning regions;

a fuel injection quantity determining means for determining a fuel injection quantity by modifying a basic injection quantity corresponding to an engine operating condition, in accordance with said feedback correction quantity and said first and second learning variables;

a fuel supplying means for supplying said fuel injection quantity of fuel to an intake passage of said engine;

a first updating means for updating said first learning variable stored in said first memory section at a fast learning rate in accordance with said feedback correction quantity; and a second updating means for updating said second learning variable stored in said second memory section at a slow learning rate which is lower than said fast learning rate in accordance with at least one of said first and second learning variables.

6. An air fuel ratio control system according to claim 5 wherein said first memory section includes a first storing means for storing a plurality of values of said first learning variable each of which corresponds to a unique one of said plurality of subregions of said engine operating region, and said second memory section includes a second storing means for storing only one value of said second learning variable for said second learning region containing all of said first learning regions in said engine operating region;

said control system further comprising a reading means for reading the value of said first learning variable in the subregion corresponding to a current engine operating condition, from said first storing means, and for reading the value of said second learning variable from said second storing means; and said fuel injection quantity determining means includes a means for determining said basic injection quantity in accordance with said feedback correction quantity and the values of said first and second learning variables determined by said reading means.

7. An air fuel ratio control system according to claim 5 wherein said control system further comprises a calculating means for calculating a learning quantity which is a sum of said first and second learning variables, said fuel injection quantity determining means includes a means for determining said fuel injection quantity by modifying said basic injection quantity in accordance with said learning quantity and said feedback correction quantity.

8. An air fuel ratio control system for an engine, comprising:

a sensor group comprising an oxygen sensor for sensing an actual air fuel ratio of an exhaust gas mixture from said engine, a first parameter sensor for sensing a first engine operating parameter distinct from an engine temperature, and a second parameter sensor for sensing a second engine operating parameter distinct from the engine temperature;

an actuator for varying a fuel quantity supplied to said engine in accordance with a control signal, said actuator comprising a fuel injector; and a control unit for producing said control signal in accordance with signals sent from said sensor group, said control unit comprising;

a first memory section for storing a table of values of a first learning variable each value of which is identified by a set of a value of a first argument determined by said first engine operating parameter and a value of a second argument determined by said second engine operating parameter;

a second memory section for storing a value of a second learning variable; and a processing section for determining a basic fuel supply quantity in accordance with said first and second engine operating parameters independently of the engine temperature, determining a feedback correction quantity in accordance with the signal supplied from said oxygen sensor, determining a learning quantity which is determined in accordance with said first learning variable and said second learning variable by obtaining one of the values of said first learning variable in accordance with said first and second operating parameters from said table stored in said first memory section and obtaining the value of said second learning variable stored in said second memory section, determining a desired fuel supply quantity represented by said control signal by modifying said basic fuel supply quantity with said feedback correction quantity and said learning quantity, updating each value of said first learning variable at a first rate, and updating the value of said second learning variable gradually at a second rate lower than said first rate.

9. A control system according to claim 8 wherein said first parameter sensor is a sensor for sensing an engine load of said engine, said second parameter sensor is a sensor for sensing an engine speed of said engine, said first argument is equal to said basic fuel supply quantity which is determined by said engine load and said engine speed, and said second argument is equal to said engine speed.

10. A control system according to claim 8 wherein said first parameter sensor is a sensor for sensing an engine load of said engine, and said second parameter sensor is a sensor for sensing an engine speed of said engine.

11. A control system according to claim 8 wherein said sensor group further comprises a third parameter sensor for sensing a third engine operating parameter which represents the engine temperature of said engine, and said control unit produces said control signal in accordance with at least the signals sent from said first, second and third parameter sensors and said oxygen sensor.

12. A control system according to claim 8 wherein each of the values of said first learning variable stored in said first memory section is assigned to a unique one of a plurality of subregions into which a predetermined engine operating region is divided, and the value of said second learning variable is updated in said engine operating range while each value of said first learning variable is updated only in the corresponding one of said subregions.

13. A control system according to claim 8 wherein said processing section of said control unit includes a means for determining said learning quantity which is a sum of said first and second learning variables by obtaining one of the values of said first learning variable in accordance with said first and second operating parameters from said table stored in said first memory section and obtaining the value of said second learning variable stored in said second memory section without regard to said first and second operating parameters.

14. A control system according to claim 13 wherein said processing section of said control unit comprises a dual updating means for updating the values of said first learning variable stored in said first memory section in accordance with said feedback correction quantity at said first rate between a first upper limit value of said first learning variable and a first lower limit value of said first learning variable, and for updating the value of said second learning variable stored in said second memory section in accordance with said learning quantity at said second rate.

15. A control system according to claim 14 wherein said processing section of said control unit further comprises a fuel injection quantity determining means for determining said desired fuel supply quantity by multiplying said basic fuel supply quantity by an adaptive feedback factor which is determined by a sum of said feedback correction quantity and said learning quantity.

16. A control system according to claim 15 wherein said first memory section comprises a plurality of memory subsections each of which stores one of the values of said first learning variable corresponding to one of subdivisions of an engine operating region determined by said first and second arguments.

17. A control system according to claim 16 wherein said dual updating means of said processing section comprises a first updating means for determining a deviation of an average of said feedback correction quantity from a predetermined neutral value, for selecting one of said subdivisions of said engine operating region in accordance with said first and second engine operating parameters, and for replacing a current entry which is the value of said first learning variable stored in the selected one of said memory subsections, with a new entry which is a sum of the current entry and a product resulting from multiplication of said first rate and said deviation of the average of said feedback correction quantity.

18. A control system according to claim 17 wherein said first updating means includes a means for limiting all the values of said first learning variable between said first upper limit value and said first lower limit values.

19. A control system according to claim 18 wherein said first upper limit value of said first learning variable is equal to 110%, and said first lower limit value of said first learning variable is equal to 90%.

20. A control system according to claim 18 wherein said dual updating means further comprises a second updating means for replacing a current entry which is the value of said second learning variable stored in said second memory section, with a new entry which is a linear combination of the current entry of said second learning variable and a product resulting from multiplication of said learning quantity and said second rate.

21. A control system according to claim 20 wherein said second updating means includes a means for comparing an error which is a difference of a sum of said feedback correction quantity and said first learning variable from said predetermined neutral value, with each of a lean side limit value and a rich side limit value, comparing said second learning variable with said predetermined neutral value, and determining the new entry said second variable which, on one hand, is equal to a sum obtained by adding an additional quantity to the old entry of said second learning variable when said error is equal to or greater than said lean side limit value and when said error is greater than said rich side limit value and said second learning variable is equal to or smaller than said predetermined neutral value, and which, on the other hand, is equal to a difference obtained by subtracting said additional quantity from the old entry of said second learning variable when said error is smaller than said lean side limit value and said second learning variable is equal to or greater than said predetermined neutral value and when said error is equal to or smaller than said rich side limit value, said additional quantity being a product obtained by multiplying said second rate by a fraction whose numerator is the sum of said first and second learning variables and whose denominator is said predetermined neutral value.

22. A control system according to claim 21 wherein said second updating means includes a means for limiting said second learning variable between a second upper limit value and a second lower limit value.

23. A control system according to claim 22 wherein a first learning range between said first upper and lower limit values of said first learning variable is equal to or smaller than a second learning range between said second upper and lower limit values of said second learning variable.

24. A control system according to claim 23 wherein said first updating means comprises a first condition discriminating means for allowing said first learning variable to be updated only when a first predetermined condition is satisfied, and said second updating means comprises a second condition discriminating means for allowing said second learning variable to be updated only when a second predetermined condition is satisfied.

25. A control system according to claim 24 wherein said first condition discriminating means includes a means for allowing said first updating means to update said first learning variable only when the engine operating condition remains in one of said subdivisions of the engine operating region for a time equal to or longer than a predetermined time duration.

* * * * *